US012714230B2

(12) United States Patent
Bengtsson et al.

(10) Patent No.: US 12,714,230 B2
(45) Date of Patent: Aug. 25, 2026

(54) HEADBOARD

(71) Applicant: Inter IKEA Systems B.V., LN Delft (NL)

(72) Inventors: Jens Bengtsson, Almhult (SE); Magnus Bergh, Eslöv (SE)

(73) Assignee: Inter IKEA Systems B.V., LN Delft (NL)

( * ) Notice: Subject to any disclaimer, the term of this patent is extended or adjusted under 35 U.S.C. 154(b) by 326 days.

(21) Appl. No.: 17/784,218

(22) PCT Filed: Dec. 11, 2020

(86) PCT No.: PCT/SE2020/051204

§ 371 (c)(1),
(2) Date: Jun. 10, 2022

(87) PCT Pub. No.: WO2021/118449

PCT Pub. Date: Jun. 17, 2021

(65) Prior Publication Data

US 2023/0042530 A1 Feb. 9, 2023

(30) Foreign Application Priority Data

Dec. 13, 2019 (SE) ..... 1951457-9

(51) Int. Cl.

| | |
|---|---|
| ***A47C 19/02*** | (2006.01) |
| ***A47C 19/12*** | (2006.01) |
| ***A47C 19/20*** | (2006.01) |

(52) U.S. Cl.

CPC ..... *A47C 19/022* (2013.01); *A47C 19/021* (2013.01); *A47C 19/12* (2013.01);
(Continued)

(58) Field of Classification Search

CPC ..... A47C 19/022; A47C 19/00; A47C 19/005; A47C 19/02; A47C 19/021; A47C 19/024;
(Continued)

(56) References Cited

U.S. PATENT DOCUMENTS

| | | | | |
|---|---|---|---|---|
| 2,641,779 A | | 6/1953 | Gill | |
| 5,771,508 A | * | 6/1998 | Messina | A47C 19/022 5/634 |

(Continued)

FOREIGN PATENT DOCUMENTS

| | | | | |
|---|---|---|---|---|
| CA | 3013379 C | * | 12/2018 | A47C 19/021 |
| CN | 101258970 A | | 9/2008 | |

(Continued)

OTHER PUBLICATIONS

PCT International Search Report for PCT Application No. PCT/SE2020/051204 mailed Feb. 16, 2021 (5 pages).

(Continued)

*Primary Examiner* — Justin C Mikowski
*Assistant Examiner* — Deborah Talitha Gedeon
(74) *Attorney, Agent, or Firm* — Merchant & Gould P.C.

(57) ABSTRACT

A headboard to be used with a bedframe, including a first part (110) and a second part (120), wherein the first part (110) and the second part (120) are connectable to each other in order to form the headboard (100), and a method for assembling the headboard (100).

29 Claims, 8 Drawing Sheets

(52) U.S. Cl.
CPC ..... *A47C 19/122* (2013.01); *A47C 19/124* (2013.01); *A47C 19/126* (2013.01); *A47C 19/128* (2013.01); *A47C 19/202* (2013.01)

(58) Field of Classification Search
CPC ... A47C 19/025; A47C 19/027; A47C 19/028; A47C 19/04; A47C 19/045; A47C 19/12; A47C 19/122; A47C 19/124; A47C 19/126; A47C 19/128; A47C 19/14; A47C 19/20; A47C 19/202; A47C 19/205; A47C 19/22; A47C 19/207; F16B 12/54; F16B 12/56
USPC ..... 5/285, 53.1, 53.2, 634, 183
See application file for complete search history.

(56) References Cited

U.S. PATENT DOCUMENTS

| | | | | |
|---|---|---|---|---|
| 7,003,822 | B1 * | 2/2006 | Sheehy | A47C 19/005 5/200.1 |
| 7,376,987 | B2 * | 5/2008 | Barnes | A47D 11/005 5/2.1 |
| 8,146,190 | B1 * | 4/2012 | Wolfe | A47C 20/027 5/633 |
| 8,850,638 | B1 * | 10/2014 | Suh | A47C 19/022 5/311 |
| 2003/0024045 | A1 * | 2/2003 | Bellows | A47C 19/021 5/200.1 |
| 2006/0037135 | A1 * | 2/2006 | Yang | A47C 19/022 5/53.1 |
| 2009/0288253 | A1 | 11/2009 | Jin | |
| 2017/0071355 | A1 * | 3/2017 | Oh | A47C 17/82 |

FOREIGN PATENT DOCUMENTS

| | | | |
|---|---|---|---|
| CN | 201205115 | Y | 3/2009 |
| CN | 203987056 | U | 12/2014 |
| CN | 205728851 | U | 11/2016 |
| CN | 207306462 | U | 5/2018 |
| CN | 207532187 | U | 6/2018 |
| CN | 209186122 | U | 8/2019 |
| CN | 209269106 | U | 8/2019 |
| CN | 209391513 | U | 9/2019 |
| CN | 209547562 | U | 10/2019 |
| CN | 210520565 | U | 5/2020 |
| JP | S6140962 | U | 3/1986 |
| JP | H0458172 | U | 5/1992 |
| KR | 20100000593 | U | 1/2010 |
| KR | 101449946 | B1 | 10/2014 |

OTHER PUBLICATIONS

PCT International Search Report for PCT Application No. PCT/SE2020/051204 mailed Feb. 16, 2021 (8 pages).
Swedish Search Report for SE Application No. 1951457-9 mailed Jul. 8, 2020 (2 pages).
Swedish Office Action SE Application No. 1951457-9 mailed Jul. 8, 2020 (5 pages).
Office Action dated Oct. 28, 2023 in the corresponding Chinese patent application No. 202080086269.X (10 pages).

* cited by examiner

HEADBOARD

This application is a National Stage Application of PCT/SE2020/051204, filed 11 Dec. 2020, which claims benefit of Serial No. 1951457-9, filed 13 Dec. 2019 in Sweden, and which applications are hereby incorporated by reference in their entireties. To the extent appropriate, a claim of priority is made to each of the above disclosed applications.

FIELD OF THE INVENTION

The present invention relates to a headboard of a bed. Further, the invention relates to a method for assembling said headboard.

BACKGROUND

Headboards for bedframes are popular among consumers, since they provide comfort and an esthetical appearance to an associated bedframe. A typical size of a headboard is for instance 110 cm in height, while the width corresponds to the width of the associated bedframe (or more), e.g. 180 cm. Hence, current headboards are large and bulky, making them difficult to transport and impossible to fit with standardised pallets. In addition to the mentioned transport issues, the packages containing said headboards are ungainly, causing them to be difficult to carry for the buyer.

Thus, there is a need for a headboard being easier to transport than headboards currently available on the market.

SUMMARY

The present invention seeks to mitigate, alleviate, eliminate or circumvent one or more of the above identified deficiencies in the art and disadvantages singly or in any combination by providing a headboard to be used with a bedframe, comprising a first part and a second part. The first part and the second part are connectable to each other in order to form the headboard. The headboard disclosed herein is easy to assemble, even for a single person. The configuration of the headboard also allows for smaller packages than if the headboard is to be shipped in one piece. The smaller package may fit on a standard pallet and thus facilitate the transport. In addition, such smaller package is easier to carry for the user.

In one embodiment, the first part and the second part can be arranged in an overlap configuration.

The overlap configuration may represent a non-assembled configuration for transport and storage.

In another embodiment, in the overlap configuration, at least a part of one of the first part and the second part is received in the other one of the first part and the second part. This is beneficial since it allows for a package having smaller dimensions and thus facilitates transport of the headboard.

In yet another embodiment, when connected to each other, at least a part of one of the first part and the second part is received in the other one of the first part and the second part.

The second part may have a width being smaller than a width of said first part. This is advantageous since it allows for the second part to fit into the first part.

In one embodiment, the first part comprises a first panel, having a first front surface and a first back surface, and the second part comprises a second panel, having a second front surface and a second back surface. The first front surface and the second front surface are arranged to face the same direction when the headboard is in an assembled configuration and the first front surface and the second front surface are arranged to face opposite directions in a non-assembled configuration for transport or storage.

In another embodiment, the headboard further comprises at least two longitudinal first part beams attached to the first back surface and each being provided with a first engagement means, and at least two longitudinal second part beams attached to the second back surface and each being provided with a second engagement means. The second engagement means are configured to receive the first engagement means. This is advantageous since the first and second parts may be removably connected to each other during assembling.

In yet another embodiment, in an assembled configuration, the first and second front surfaces are facing the same direction, the upper part is connected with the bottom part through the first engagement means being in engagement with the second engagement means, and a first edge of the first panel and a second edge of the second panel are in contact with each other.

In one embodiment, in the non-assembled configuration, the first engagement means and second engagement means are engaging each other. This is advantageous since it allows for a smaller package during transportation of the headboard.

In another embodiment, the first part and the second part each comprises more than two first part beams and second part beams, respectively, for instance three, four, five or six upper part beams and second part beams. Preferably, the first part and the second part each comprises four first part beams and second part beams, respectively. This provides stability and strength for the headboard in an assembled configuration.

The upper part may comprise at least one first horizontal beam being connected to the first part beams and/or the second part may comprise at least one second horizontal beam being connected to the second part beams. The horizontal beams are beneficial since they provide support for the first and second parts.

In one embodiment, the first engagement means is in the form of a protruding male part, preferably a longitudinal rib or bracket, and the second engagement means is in the form of a hollow open ended female part, preferably being an open ended groove. This is advantageous since it is simple for the user to guide the male part into the female part. Further, it provides a secure engagement between the first and second parts.

In one embodiment, the first engagement means and the second engagement means extend along the extension of the first and bottom part beams and in parallel with the back and front surface of the first panel.

The first engagement means may be made of a plastic material. Preferably, the plastic material is polypropylene (PP). The first engagement means being made of a plastic material provides low friction during assembling, which facilitates the mounting of the first and second parts.

Further, the first engagement means may be removably attachable to openings in the first part beams. This is advantageous in that the first engagement means may be attached to the first part beams after the first and second parts have been lifted out of the package in which they are delivered. Hence, the first and second parts may be lifted straight up from the package and there is no need to lift the two parts out from the package in an assembled configuration.

The removably attachable first engagement means may be attached by a fastening means. In such case, the fastening means is preferably a screw, nail, pin or plug. This is advantageous since the removable first engagement means may easily be attached to the first part beams.

The headboard may be covered with a cover material, preferably a cover fabric or foam. This provides additional protection of the headboard and may provide an aesthetic appearance and comfort for the user. In addition, the headboard is modular since it may be covered with foam or fabric, depending on various preferences.

In a second aspect, there is provided a method for assembling a headboard. The method comprises the steps of connecting a first part and a second part to each other, whereby the headboard is formed. This is advantageous in that the assembling process is simple, and may be performed by a single person.

In one embodiment, before the step of connecting the first part and the second part, the method comprises the steps of providing a package comprising the first part and the second part of a headboard and separating the first and second parts from each other.

In another embodiment, the method further comprises the step of turning the first part relative the second part such that a first front side of the first part face in the same direction as a second front side of the second part. Preferably, the first part is turned 180 degrees before the step connecting the first part and the second part to each other.

In yet another embodiment, the method further comprises the step of attaching first part engagement means to openings of the first part beams before the step of connecting said first part and said second part to each other.

In one embodiment, the method further comprises the step of attaching the assembled headboard to a bedframe. This is advantageous since the headboard may provide back support for a person using the bed.

In another embodiment, the method further comprises covering the assembled headboard with a cover material. Preferably, the cover material is a foam or cover fabric. Hence, the headboard is modular since it may be covered with foam or fabric, depending on users likings. Thus, the headboard may be adapted to various preferences.

Further advantageous features of the invention are elaborated in embodiments disclosed herein. In addition, advantageous features of the invention are defined in the dependent claims.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DETAILED EMBODIMENTS

Hereinafter, certain embodiments will be described more fully with reference to the accompanying drawings. The invention may, however, be embodied in many different forms and should not be construed as limited to the embodiments set forth herein. Rather, these embodiments are provided by way of example so that this disclosure will be thorough and complete, and will fully convey the scope of the invention, such as it is defined in the appended claims, to those skilled in the art.

Figure 1:
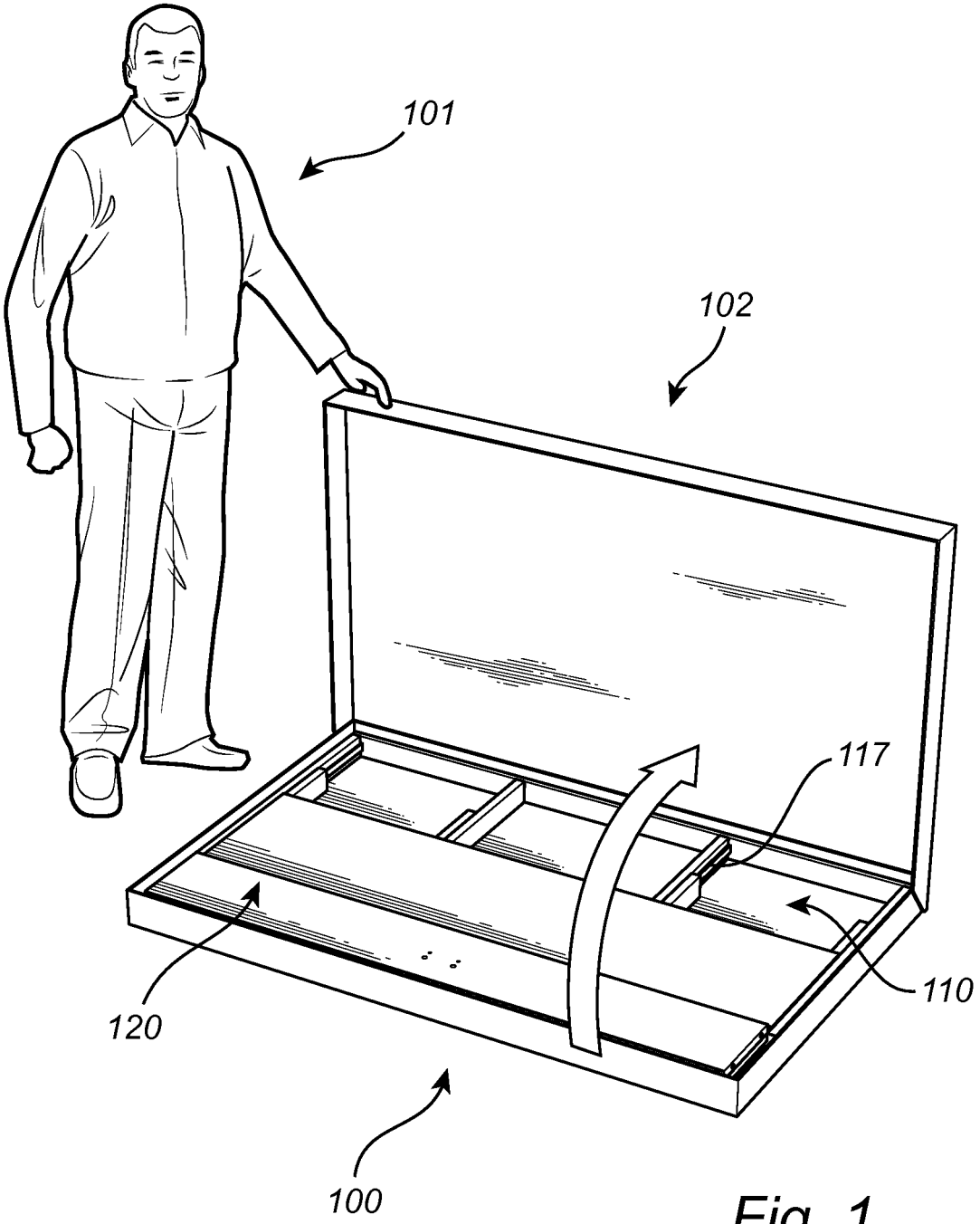
FIG. 1 depicts a user standing next to a package containing a headboard according to an embodiment.

With reference to FIG. 1, a user 101 is shown standing next to an opened package 102 containing a first part 110 and a second part 120 of a split headboard 100. In the shown example the first part 110 will form an upper part of the headboard 100, while the second part 120 will form a bottom part of the headboard 100. Hence, the first and second part may also be referred to as an upper part 110 and a bottom part 120 herein, respectively. The upper and bottom parts 110, 120 are hollow, such that the bottom part 120 can be housed within the upper part 110 in the package 102, as shown in FIG. 1, or vice versa. The fact that the bottom part 120 is inserted into the upper part 110 reduces the size of the package 102, from for instance 110 cm to about 70 cm, which means that the package 102 will fit in a standard pallet. The size of the package 102 depends on the dimensions of the assembled headboard.

The upper part 110 and the bottom part 120 each comprises a first engagement means 117 and a second engagement means 127, respectively, also referred to as upper engagement means and bottom engagement means herein. When the split headboard of this embodiment is in its packaged, or knocked-down configuration as shown in FIG. 1, in which the bottom part 120 is inserted into the upper part 110, the upper engagement means 117 and the bottom engagement means 127 are connected to each other, thereby ensuring a fixed positioning of the upper and bottom parts 110, 120. The upper and bottom engagement means 117, 127 will be described more in the following. The first part 110 and the second part 120 may each be arranged as a left part or right part, respectively, or vice versa (not shown).

Figure 2:
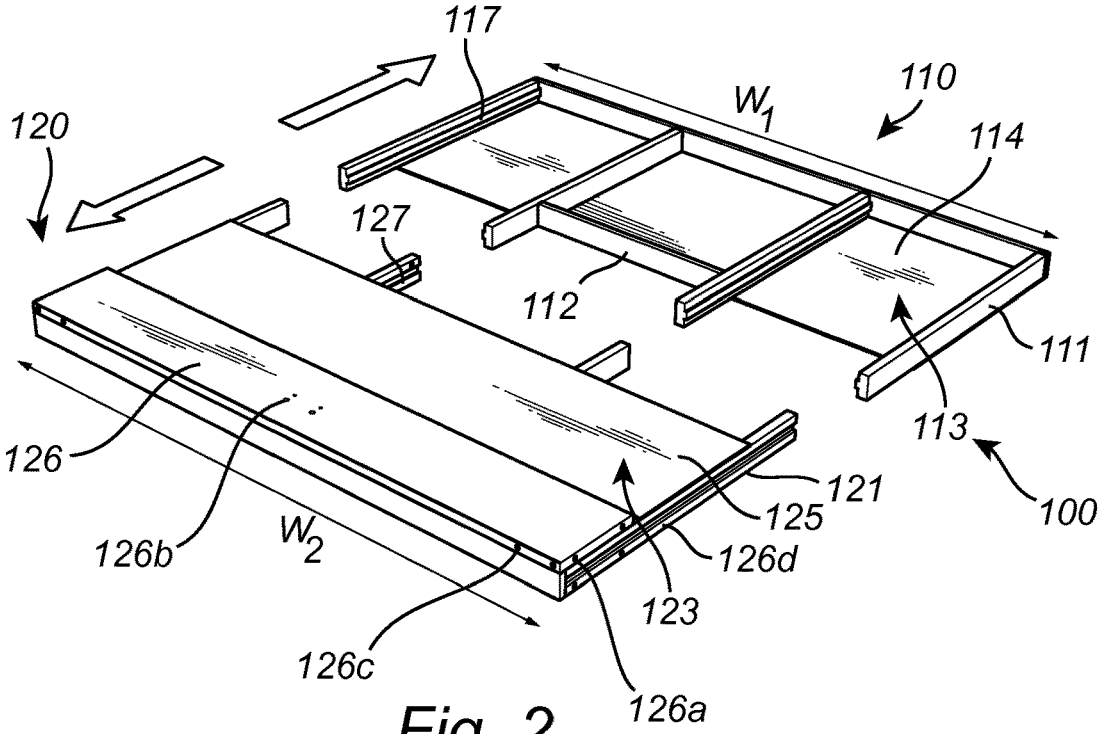
FIGS. 2-6 are isometric views of a headboard during assembly, according to an embodiment.

In FIG. 2, the package 102 has been removed (not shown), and the upper part 110 and the bottom part 120 have been separated from each other by pulling the parts 110, 120 apart in the direction indicated by the arrows. A width $W_1$ of the upper part 110 is slightly broader than a width $W_2$ of the bottom part 120, such that the bottom part 120 may fit into a cavity of the upper part 110. The widths $W_1$, $W_2$ are for instance in the range of 90 cm to 220 cm and depend on the width of the bedframe to which the headboard 100 should be mounted. Height ratios between the upper part 110 and the bottom part 120 may vary. The ratio between the heights should preferably be in a range such that the first part 110 and second part 120 arranged in a packaging arrangement fits onto a standard pallet.

The upper part 110 comprises four longitudinal upper part beams 111 and the bottom part 120 comprises four longitudinal bottom part beams 121. The upper part beams 111 and the bottom part beams 121 are also referred to as first part beams 111 and second part beams 121, respectively.

Further, the upper part 110 has upper horizontal beams 112 and an upper panel 113, also referred to as a first panel 113 herein. The horizontal beams 112 are perpendicularly arranged in relation to the longitudinal beams. The upper panel 113 has a back surface 114 and a front surface 115 (not shown). The bottom part 120 comprises a bottom panel 123, also referred to as the second panel 123 herein, of which a front surface 125 is visible. The bottom panel 123 has a back surface (not shown in FIG. 2). The upper part beams 111 and the upper horizontal beams 112 are attached to the back surface 114 of the upper part 110, and the bottom part beams 121 are attached to the back surface of the bottom part 120.

The upper panel 113 and the bottom panel 123 are preferably made of a wood board, such as plywood, MDF, or similar. The beams 111, 121, 112 are preferably made from wood, such as solid wood. In other embodiments of the headboard 100 disclosed herein, the upper part 110 and the bottom part 120 may comprise fewer or additional longitudinal upper part beams 111 or bottom part beams 121, respectively. For instance, the headboard 100 may comprise two upper part beams 111 and two bottom part beams 121, or six upper part beams 111 and six bottom part beams 121.

In addition, the bottom part 120 has an attachment segment 126 having openings 126*a-c* configured to receive attachment means, such as a screw, bolt or plug, to connect the headboard 100, once it is assembled, to a bedframe. The outermost bottom part beams 121 may also comprise such openings 126*d* configured to receive attachment means to connect the headboard 100 to a bedframe. If the first and second parts 110, 120 are arranged as a left and right part, the attachment segment 126 is shared at a bottom end between the two parts 110, 120 (not shown).

Each of the upper part beams 111 of the upper part 110 is provided with first engagement means 117, also referred to as upper engagement means 117. In the embodiment shown in FIG. 2, the upper engagement means 117 is a male part in the form of a longitudinal rib 117 extending along the length of the upper part beams 111. The upper engagement means 117 on the two outermost upper part beams 111 face and extend towards a centre of the upper part 110, whereas the upper engagement means 117 on the two innermost upper part beams 111 are directed to extend laterally.

Further, the bottom part beams 121 each comprise the second engagement means 127, also referred to as the bottom engagement means 127 herein. In this embodiment, the bottom engagement means 127 is a female part in the form of a longitudinal open ended slit, or groove, 127 extending along the length of the bottom part beams 121. The grooves 127 are designed such that a cavity of the groove 127 corresponds to the protruding shape of the male ribs 117. Thus, the grooves 127 are configured to engage the ribs 117 when the upper part 110 and the lower part 120 are joined.

On the two outermost bottom part beams 121, the open ended grooves 127 are arranged such that they face laterally outwards. The two open ended grooves 127 provided on the two innermost bottom part beams 121, are arranged on a side of the bottom part beams 121 being perpendicular to the bottom panel 123 and facing towards a centre of the bottom part 120. A length of protruding upper engagement means 117 may vary and they may be removably attachable to the upper part beams 111, as will be exemplified and explained in the following with reference to FIGS. 8A-C.

Figure 3:
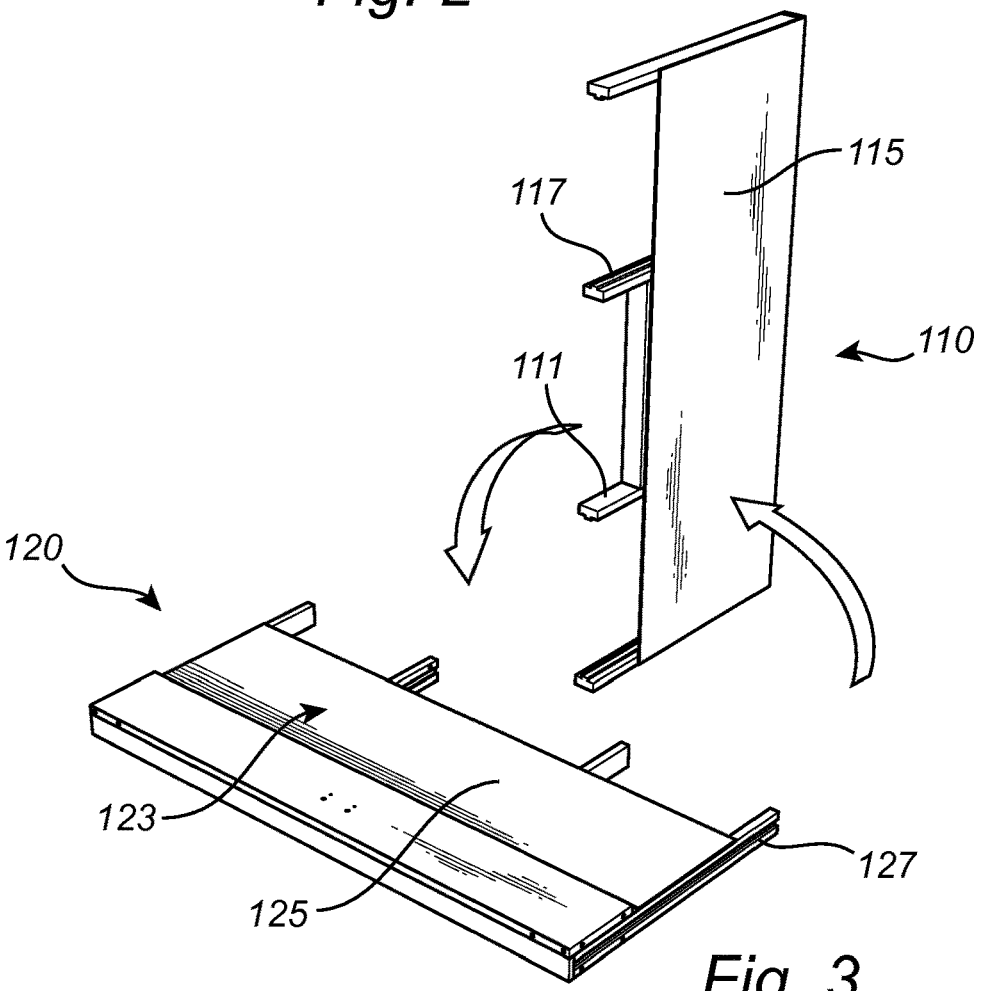

In FIG. 3, the upper part 110 is about to be turned 180 degrees, indicated by the arrows in the figure, such that the front surface 115 faces the same direction as the front surface 125 of the bottom part 120.

Figure 4:
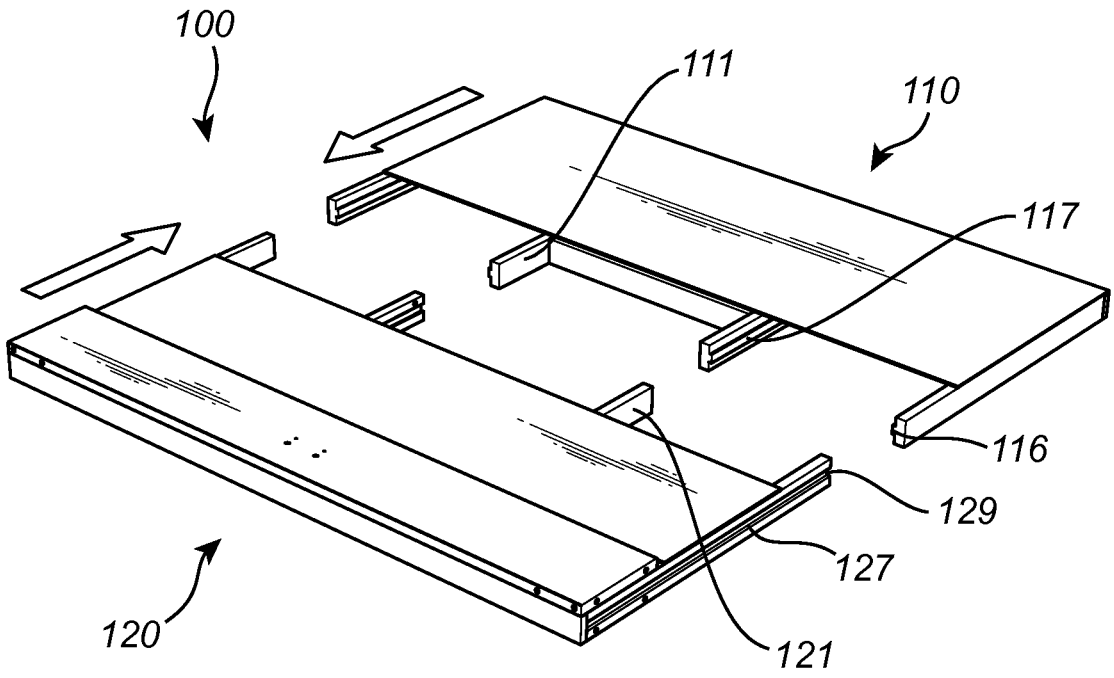

Now turning to FIG. 4, the upper part 110 and the bottom part 120 have been positioned such that each upper frame beam 111 is essentially longitudinally aligned with a bottom frame beam 121. The arrows in FIG. 4 illustrate how the upper and bottom parts 110, 120 are to be moved in order to attach the two parts 110, 120 to each other. Each open end 129 of the bottom engagement means 127 is aligned with an upper engagement means end 116 such that the upper engagement means ends 116 can be fitted into the open ends 129. When the upper part 110 is brought into contact with the bottom part 120, the upper engagement means 117 will fit and slide into engagement with the bottom engagement means 127. Subsequently, the upper part 110 and the bottom part 120 are pushed together forming a headboard 100.

To summarize the steps of assembling the split headboard, when the upper part 110 and the bottom part 120 are arranged in the package or transport configuration shown in FIG. 1, a user assembling the headboard 100 will first separate the upper part 110 and the bottom part 120 from each other as shown in FIG. 2, with the front surfaces 125, 115 facing in opposite directions. Thereafter, the upper part, or the lower part, is turned 180 degrees, which is illustrated by the arrows in FIG. 3, such that the bottom part beams 121 and the upper part beams 111 are positioned with each open end 129 of the bottom engagement means 127 aligned with an upper engagement means end 116 such that the upper engagement means ends 116 can be fitted into the open ends 129. Finally, the upper part 110 and the bottom part 120 are pushed together, such that the upper engagement means 117 slide in the bottom engagement means 127.

Figure 5:
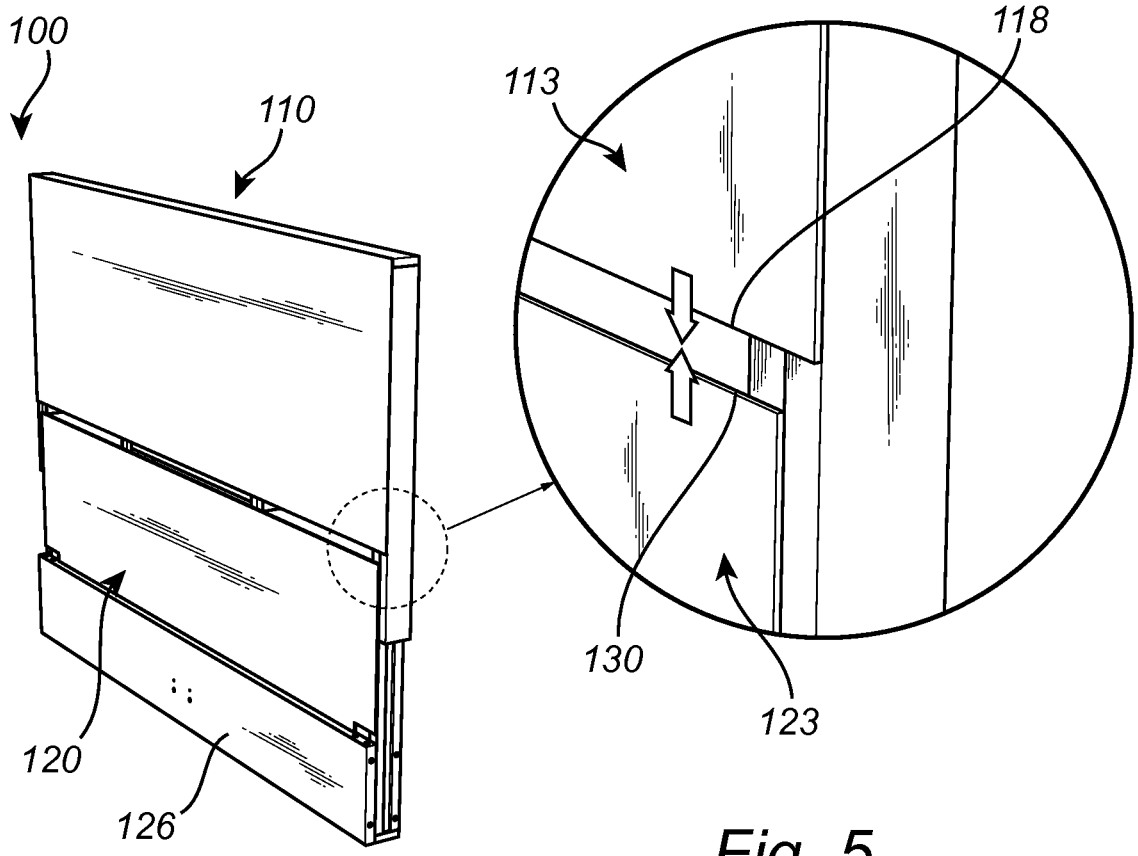

With reference to FIG. 5, the upper engagement means 117 have been inserted into and engaged with the bottom engagement means 127, as described above, and the headboard 100 is nearly completely assembled. As shown in the encircled enlarged portion of FIG. 5, there is only a small gap between a lower edge 118 of the upper panel 113 and an upper edge 130 of the bottom panel 123. When the upper edge 130 and the lower edge 118 are brought into direct contact with each other, the upper part 110 and the bottom part 120 cannot be brought closer to each other and the headboard 100 has been assembled. The lower edge 118 will support the upper part 110, preventing the upper part 110 from being pushed or moving further downwards towards the attachment segment 126 when the headboard 100 is standing in an upright position as shown in FIG. 5.

Figure 6:
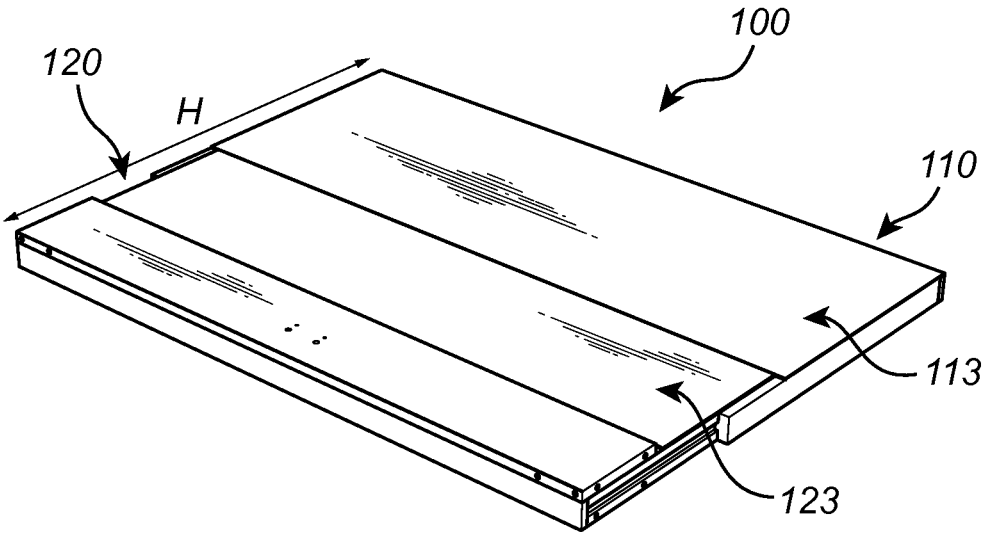

FIG. 6 shows the completely assembled headboard 100. A height H of the headboard 100 is for instance about 100 cm to 170 cm. The upper part 110 and the lower part 120 have been brought together and the split headboard 100 is ready to be mounted to a bedframe. The upper part 110 is slightly wider than the bottom part 120, causing the width of the upper panel 113 being broader than the width of the bottom panel 123.

Figure 7:
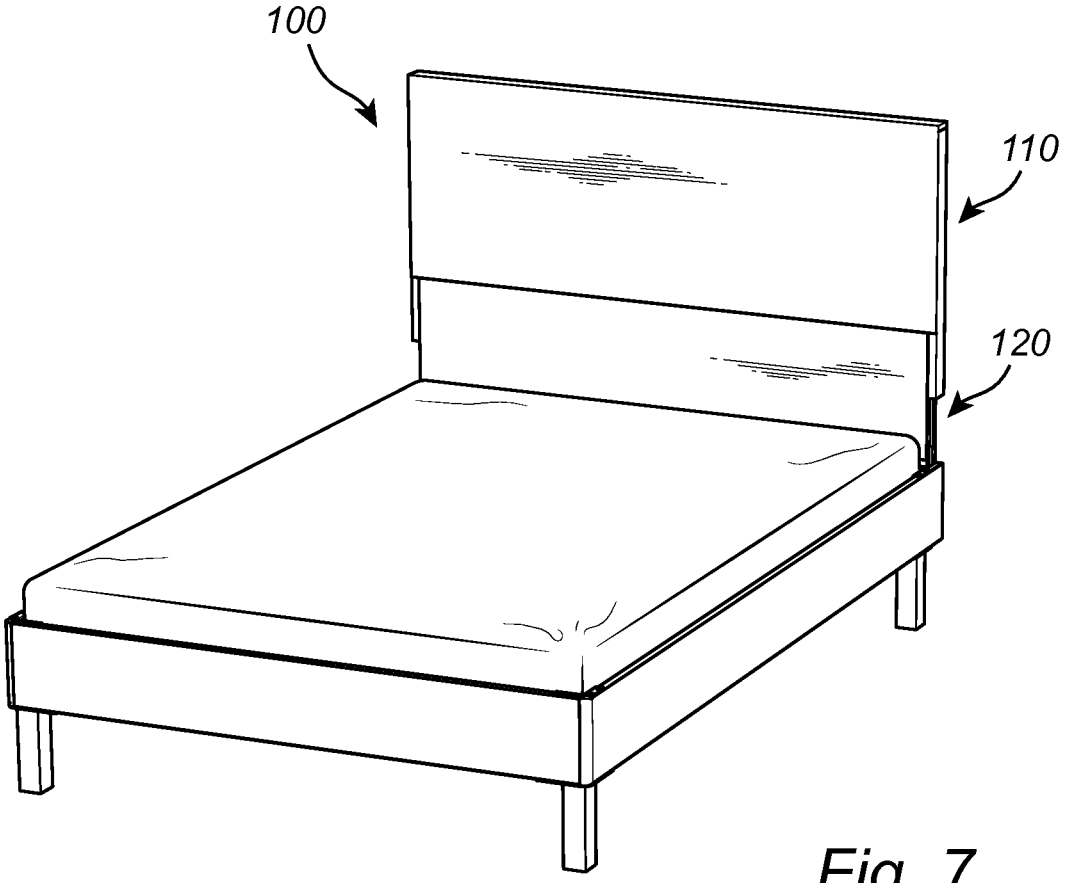
FIG. 7 is an isometric view of the headboard of FIGS. 2-6 in use with an associated bedframe.

In FIG. 7, the headboard 100 has been attached to a bedframe. A cover material, such as a foam or cover fabric, may cover the headboard 100 and be fastened using for instance straps provided with a hook and loop fastener, for instance Velcro (not shown). This enhances the esthetical appearance of the headboard 100 and may provide additional comfort for the user. Foam material can be pre-attached to the upper part 110 and to the bottom part 120. A cover fabric may be pre-attached to the upper part 110 and then, when the headboard is assembled as shown in FIG. 7, the cover fabric can be attached to cover also the bottom part 120.

Figure 8A:
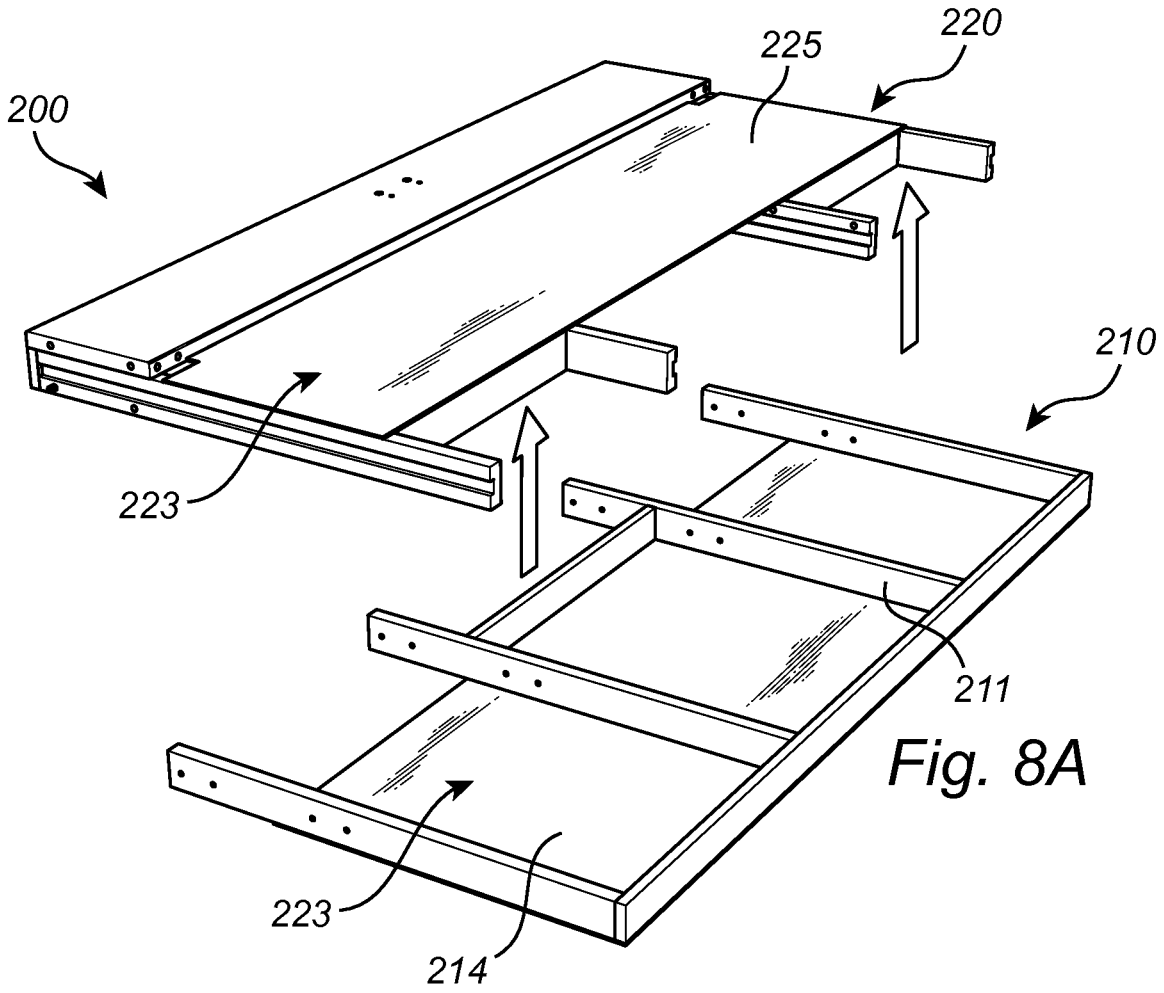
FIGS. 8A-C are isometric views of a headboard during assembly, according to another embodiment.
Figure 8B:
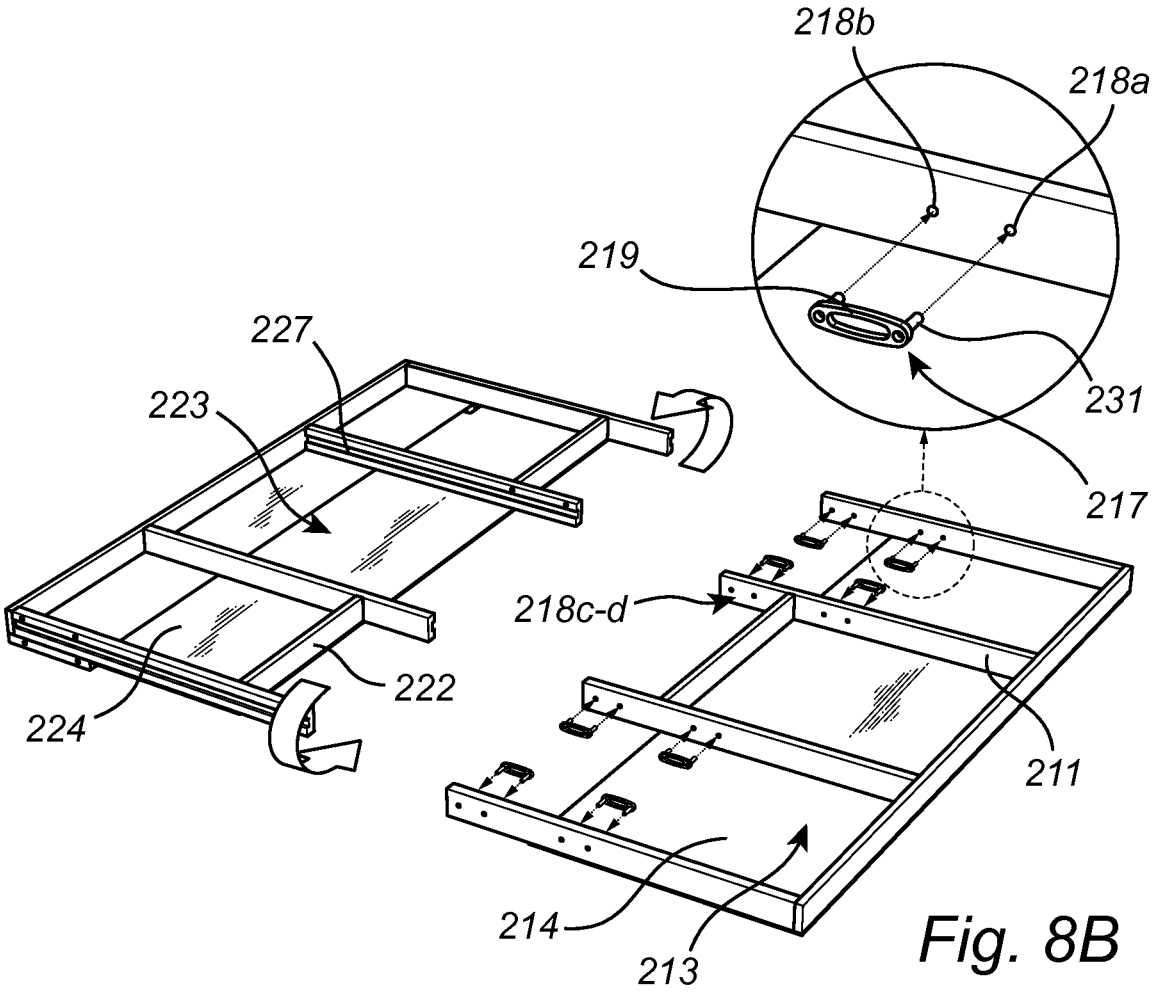

With reference to FIGS. 8A and 8B, an upper part 210 and a bottom part 220 of a headboard 200 according to another embodiment is shown. The general concept of providing a headboard 200 comprising an upper part 210 and a bottom part 220, which can be positioned in a transport position and wherein an assembled position is reached by turning one of the upper or lower parts 210, 220, 180 degrees with respect to the other is the same as for the embodiment shown in FIGS. 1-7. However, in this embodiment, upper engagement means 217 are releasably attachable to upper part beams 211 of the upper part 210.

In FIG. 8B, the bottom part 220 has been turned 180 degrees (indicated by the arrows in FIG. 8B) such that the back surface 224 of the bottom panel 223 is facing in the same direction as the back surface 214 of the upper panel 213. The bottom part 220 has the same configuration as the bottom part 120 of the embodiment shown in FIGS. 1-7. Since the bottom part 220 is illustrated from another perspective than in FIGS. 1-7, the back surface 224 of the bottom panel 223 and bottom horizontal beams 222 are visible.

Each longitudinal upper frame beam 211 has a plurality of openings 218*a-d* configured to receive and engage the upper engagement means 217 being in the form of removably attachable brackets 219 as shown in FIG. 8B.

FIG. 8B shows how the brackets 219 may be attached to the longitudinal upper part beams 211. Two brackets 219 are mounted onto each upper frame beam 211. However, the upper part beams 211 may be equipped with any suitable number of brackets 219. The openings 218*a-d* and the brackets 219 are arranged on the same sides of the longitudinal upper part beams 211 as the bottom engagement means 127 of the first embodiment. Thus, the upper engagement means 217, being the brackets 219, are in the form a protruding male part. The two brackets 219 on the two outermost upper part beams 211 face towards a centre of the upper part 210, whereas the brackets 219 on the two innermost upper part beams 211 are directed laterally outwards.

The female slits 227 of the bottom part 220 have a shape such that they may receive the brackets 219 fitting snugly therein when the upper part 210 and the lower part 220 are joined together. The brackets 219 may be made of a plastic material. However, the brackets 219 may be made of another material providing desirable sliding cooperation between the brackets 219 and the grooves 227.

In this embodiment, the brackets 219 are elongated and have rounded edges, being substantially round. The rounded shape may facilitate fitting bracket 219 into the groove 227. The brackets 219 extend along the upper part beams 211 and in parallel with the upper panel 213. However, the brackets 219 may be formed in any shape, which can fit into and engage the grooves 227 and for a connection between the upper part 210 and he bottom part 220. The brackets 219 further comprise a hollow centre, which may increase the flexibility of the brackets 219 to take up some tolerance of the groove 227 and lower the risk of having too much play between the bracket and groove 227. In addition the hollow centre of the bracket may limit the amount of material needed for manufacturing said brackets 219. The bracket 219 may be inserted by pushing two pins 231 of the bracket 219 into the openings 218*a-d*, e.g. bore holes, of the upper part beams 211. In one embodiment there is no need of separate attachment means for the bracket 219 but the bracket 219 are held in pace by press fitting the pins 231 into the openings 218*a-d*.

Figure 8C:
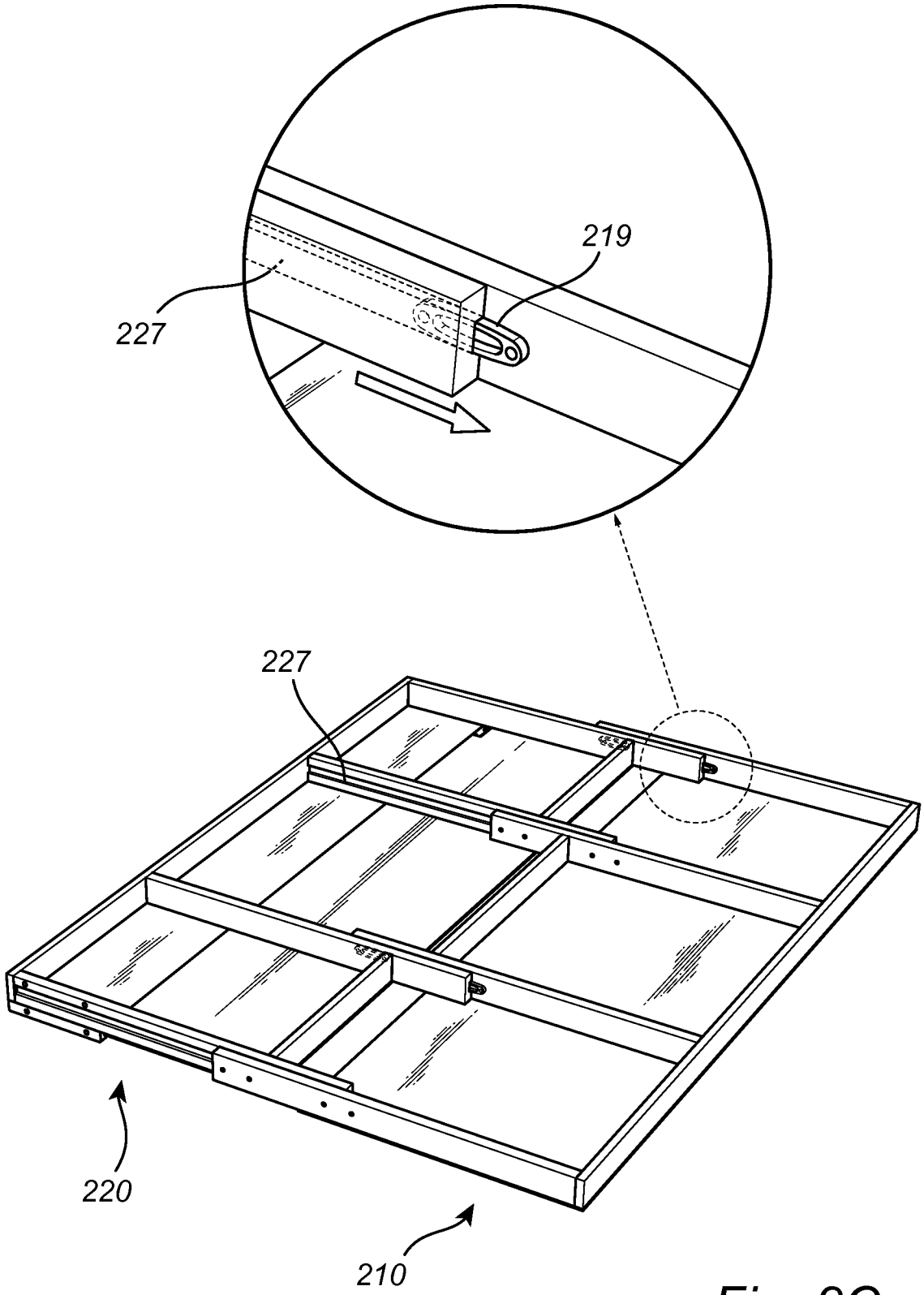

With reference to FIG. 8C, the upper part 210 and the bottom part 220 have been connected to each other. An enlarged view of the detail where the bracket 219 is engaged in the groove 227 is also shown in FIG. 8C. As shown in the encircled enlarged view, the bracket 219 fits snugly inside the groove 227.

Figure 9:
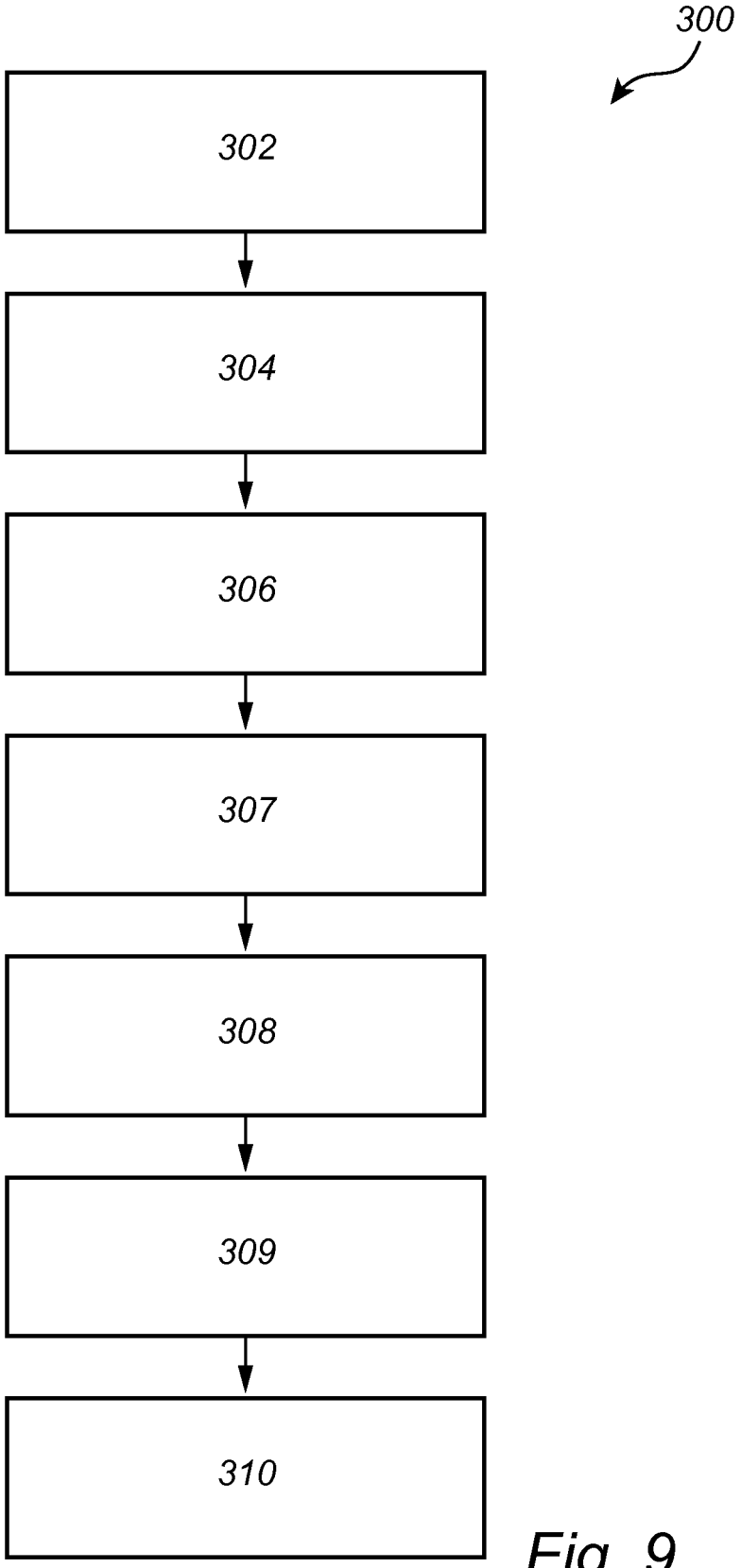
FIG. 9 is a schematic view of a method for providing a headboard according to an embodiment.

Now turning to FIG. 9, a method 300 for providing a headboard is schematically shown. The method 300 comprises a first step 302 of providing a package 102 comprising the upper part 110 and the bottom part 120 arranged in an overlap configuration. In a second step 304, the upper part 110 and the bottom part 120 are separated from each other (as shown in FIG. 2).

Subsequently, in a third step 306, the upper part 110 is turned 180 degrees, as shown with reference to FIG. 3, such that the front surface 115 of the upper part 110 and the front surface 125 of the bottom part 120 face in the same direction.

In a fourth step 308, the upper part 110 and the bottom part 120 are connected to each other by engaging the upper and bottom part engagement means 117, 127 with each other, whereby a headboard 100 is formed.

Optionally, if the upper engagement means 117 are releasable, they are attached to the upper part 110 in a step 307 before connecting 308 the upper part 110 and the bottom part 120 to each other. The method may further comprise steps of attaching 309 the headboard 100 to a bedframe and covering 310 the headboard 100 with a cover material.

Without further elaboration, it is believed that one skilled in the art may, using the preceding description, utilize the present invention to its fullest extent. The preceding preferred specific embodiments are, therefore, to be construed as merely illustrative and not limitative of the disclosure in any way whatsoever.

Although the present invention has been described above with reference to specific embodiments, it is not intended to be limited to the specific form set forth herein. Rather, the invention is limited only by the accompanying claims and, other embodiments than the specific above are equally possible within the scope of these appended claims, e.g. different than those described above.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous.

In addition, singular references do not exclude a plurality. The terms "a", "an", "first", "second" etc. do not preclude a plurality.

The invention claimed is:

1. A headboard to be used with a bedframe, comprising a first part and a second part, wherein the first part and the second part are connectable to each other in order to form the headboard, wherein the first part and the second part can be arranged in an overlap configuration, wherein in the overlap configuration, at least a part of one of the first part and the second part is received in an inside portion of the other one of the first part and the second part;

wherein, when the first part and the second part are connected together to form the headboard, at least a part of one of the first part and the second part is received in an inside portion of the other one of the first part and the second part; and wherein when coupled to the bedframe, the headboard is fixed in a perpendicular direction with respect to a longitudinal direction of the bedframe.

2. The headboard according to claim 1, wherein the overlap configuration represents a non-assembled configuration for transport and storage.

3. The headboard according to claim 1, wherein when connected to each other, at least a part of one of the first part and the second part is received in the other one of the first part and the second part.

4. The headboard according to claim 1, wherein said second part has a width ($W_2$) being smaller than a width ($W_1$) of said first part.

5. The headboard according to claim 1, wherein the first part comprises a first panel, having a first front surface and a first back surface, and the second part comprises a second panel, having a second front surface and a second back surface, wherein the first front surface and the second front surface are arranged to be facing the same direction when the headboard is in an assembled configuration and wherein the first front surface and the second front surface are arranged to be facing opposite directions in a non-assembled configuration for transport or storage.

6. The headboard according to claim 5, further comprising:

at least two longitudinal first part beams attached to said first back surface and each being provided with a first engagement means, and at least two longitudinal second part beams attached to said second back surface and each being provided with a second engagement means, and wherein said second engagement means are configured to receive said first engagement means.

7. The headboard according to claim 5, wherein in an assembled configuration, said first and second front surfaces are facing the same direction, an upper part is connected with a bottom part through the first engagement means being in engagement with said second engagement means, and a first edge of the first panel and a second edge of the second panel are in contact with each other.

8. The headboard according to claim 5, wherein in the non-assembled configuration, said first engagement means and second engagement means are engaging each other.

9. The headboard according to claim 5, wherein the first part and the second part each comprises more than two first part beams and second part beams, respectively, for instance three, four, five or six upper part beams and second part beams, preferably the first part and the second part each comprises four first part beams and second part beams, respectively.

10. The headboard according to claim 5, wherein an upper part comprises at least one first horizontal beam being connected to said first part beams and/or the second part comprises at least one second horizontal beam being connected to said second part beams.

11. The headboard according to claim 5, wherein the first engagement means is in the form of a protruding male part, preferably a longitudinal rib or bracket, and the second engagement means is in the form of a hollow open ended female part, preferably being an open ended groove.

12. The headboard according to claim 5, wherein the first engagement means and the second engagement means extend along the extension of first part beams and second part beams and in parallel with the back and front surface of the first panel.

13. The headboard according to claim 5, wherein said first engagement means are made of a plastic material, preferably the engagement means are made of polypropylene (PP).

14. The headboard according to claim 5, wherein the first engagement means are removably attachable to openings in said first part beams.

15. The headboard according to claim 14, wherein said removably attachable first engagement means are attached by a fastening means, the fastening means preferably being a screw, nail, pin or plug.

16. The headboard according to claim 1, wherein said headboard is covered with a cover material, preferably a cover fabric or foam.

17. The headboard of claim 1, wherein:

the first part is an upper portion of the headboard; and the second part is a lower portion of the headboard.

18. The headboard of claim 1, wherein the first part and the second part are rotated 180 degrees with respect to each other before the at least one of the first part and the second part is received in the inside portion of the other one of the first part and the second part.

19. The headboard of claim 1, wherein the headboard only comprises the first part and the second part.

20. The headboard of claim 1, wherein the first part and the second part are flat and non-bendable.

21. The headboard of claim 1, wherein the first part and the second part are detachable from each other.

22. The headboard of claim 1, wherein the headboard is flat in a non-assembled configuration and in an assembled configuration.

23. A method for assembling a headboard, the method comprising:

providing a first part and a second part in an overlap configuration in which at least a part of one of the first part and the second part is received in an inside portion of the other one of the first part and the second part, wherein, when the first part and the second part are connected together to form the headboard, at least a part of one of the first part and the second part is received in an inside portion of the other one of the first part and the second part, and connecting the first part and the second part to each other, whereby the headboard is formed;

wherein the first part and the second part are rotated 180 degrees with respect to each other before the at least one of the first part and the second part is received in the inside portion of the other one of the first part and the second part.

24. The method according to claim 23, further comprising, before the step of connecting said first part and said second part, providing a package comprising the first part and the second part of a headboard and separating the first and second parts from each other.

25. The method according to claim 23, further comprising the step of turning the first part relative the second part such that a first front side of the first part face in the same direction as a second front side of the second part, preferably the first part is turned 180 degrees, before the step connecting said first part and said second part to each other.

26. The method according to claim 23, further comprising the step of attaching first part engagement means to openings of the first part beams before the step connecting said first part and said second part to each other.

27. The method according to claim 23, further comprising the step of attaching said assembled headboard to a bedframe.

28. The method according to claim 23, further comprising covering the assembled headboard with a cover material, preferably a foam or cover fabric.

29. The method of claim 23, wherein:

the first part is an upper portion of the headboard; and the second part is a lower portion of the headboard.

* * * * *